US005907929A

United States Patent [19]

Poma et al.

[11] Patent Number: 5,907,929

[45] Date of Patent: Jun. 1, 1999

[54] REINFORCED SHUTTER STRUCTURE

[76] Inventors: Frank Poma, 1740 SE. Clemont St., Port St. Lucie, Fla. 34984; Albert T. Purino, 18810 Misty Lake Dr., Jupiter, Fla. 33458

[21] Appl. No.: 08/976,291

[22] Filed: Nov. 21, 1997

[51] Int. Cl.[6] ..... E06B 5/10; E06B 5/12; E06B 3/28

[52] U.S. Cl. ..... 52/78; 52/202; 52/203; 52/167.1; 52/473; 49/62; 49/463

[58] Field of Search ..... 52/74, 78, 202, 52/203, 473, 167.1; 49/62, 463, 465

[56] References Cited

U.S. PATENT DOCUMENTS

| | | | |
|---|---|---|---|
| 2,877,840 | 3/1959 | Hurowitz et al. . | |
| 3,086,442 | 4/1963 | Waldron . | |
| 3,392,486 | 7/1968 | Luke . | |
| 3,550,342 | 12/1970 | South . | |
| 3,812,772 | 5/1974 | Kaiser | 49/62 X |
| 3,830,146 | 8/1974 | Kaiser | 49/62 X |
| 4,193,232 | 3/1980 | Almsted et al. | 52/202 X |
| 4,483,102 | 11/1984 | Edwards | 49/465 |
| 4,685,261 | 8/1987 | Seaquist | 52/202 |
| 4,912,877 | 4/1990 | Strydom | 49/62 X |
| 5,537,779 | 7/1996 | Jackson | 49/62 |
| 5,617,683 | 4/1997 | Ney | 52/202 |
| 5,737,874 | 4/1998 | Sipos et al. | 49/67 |

*Primary Examiner*—Robert Canfield
*Attorney, Agent, or Firm*—Malin, Haley, DiMaggio & Crosby, P.A.

[57] ABSTRACT

The present invention provides, in one embodiment, an awning that permits light and air to enter the structure to which the awning is attached, that can be utilized to protect against major storms, and that can pass strict building code standards testing. The awning includes a perimeter framework that is adapted to receive a removable rigid support plate. In an alternate embodiment, the invention provides a shutter that is inexpensive, easy and quick to manufacture, that can provide protection against major storms, and that can pass strict building code standards testing. The shutter includes modular louver sections that have an integral rigid backing plate.

15 Claims, 8 Drawing Sheets

REINFORCED SHUTTER STRUCTURE

CROSS-REFERENCE TO RELATED APPLICATIONS

Not applicable.

STATEMENT REGARDING FEDERALL SPONSORED RESEARCH OR DEVELOPMENT

Not applicable.

BACKGROUND OF THE INVENTION

1. Field of the Invention

This invention relates to protective and decorative coverings for windows, doors, and the like, and more particularly to storm shutters, awnings, and louvers to provide security and protection against large magnitude storms such as hurricanes.

2. Description of Related Art

Window and door coverings, such as awnings and shutters, are known in the art, and are used for decoration, security, weather protection, and the like.

Conventional awnings, such as "Bahama" style awnings, typically have a perimeter framework with a plurality of horizontal louvers or slats. The louvers include openings between individual louver slats to allow air and sunlight to enter the structure to which the awning is attached, and to permit persons within the structure to see out. The frame can be attached at the top by a hinge to the top of a window or other opening. The awning is presized in length and width to cover the entire window or other opening. The awning can be rotated about the hinge, with the lower portion of the awning moving in an arc relative to the hinge, and away from the lower portion of the window. The awning can thus be positioned at some desired angle relative to the window. The lower portion of the awning can be held away from the window by support arms. The arms can be removable and/or include a release mechanism to permit the lower portion of the awning to be moved toward the window to a closed position substantially parallel to the window to provide security or storm protection.

However, because the awning louvers have openings between the louver slats to allow air and sunlight to enter the structure, the protection provided is limited by the strength of the individual horizontal louver slats. Individual louver slats having an opening between adjacent slats cannot provide sufficient protection against large magnitude storms such as hurricanes.

Subsequent to hurricane Andrew hitting South Florida in August of 1992, several Florida counties have begun to require minimum building code standards for storm shutters. For example, in the Miami Florida area, Dade County standards require the shutter to withstand certain tests including a large missile impact test consisting of a length of 2"×4" wood weighing 9 pounds shot from an air cannon at approximately 34 miles per hour directly into the shutter. Conventional Bahama awnings having openings between adjacent slats fail to pass these tests.

There is a need for a Bahama style awning that provides the desirable features of the awning, can protect against major storms, and can pass strict building code standards testing.

Conventional shutters; such as Colonial style shutters typically include at least one shutter panel made of a perimeter framework and a plurality of horizontal louver slats. The shutter is typically attached at one edge by hinges to the edge of an opening such as a window or door of a structure. The shutter can be presized to cover the entire window. The shutter is normally kept in the open position adjacent to the window. The shutter can be rotated about the hinges to the closed position covering the window.

More typically, a pair of shutters can be mounted adjacent the window, one on either side. The pair of shutters can be presized such that together, when closed, they cover the entire window or other opening. When closed, the pair of shutters meet near the vertical center of the window and are connected together to form a protective cover over the entire window.

The Colonial style shutters are normally kept in the open position, and only cover the window area when closed for protection. Therefore, the horizontal louvers do not require openings between adjacent louver slats to allow air and sunlight to enter the structure. The conventional Colonial style shutter can thus have a sturdy backing plate permanently attached to the back side of the shutter, to provide sufficient support for protection against significant storms such as hurricanes. The sturdy backing plate can be attached to the perimeter framework and can cover the entire louvered area. A sturdy backing plate so attached permits a conventional shutter to pass building code standards testing, such as the Dade county large missile impact test.

However, the addition of a permanent backing plate to the shutter adds additional weight to the shutter, adds additional costs in raw material, and adds additional labor costs and time for assembly. There is a need for a Colonial style shutter that is inexpensive, easy and quick to manufacture, that can provide protection against major storms, and that can pass strict building code standards testing.

BRIEF SUMMARY OF THE INVENTION

The present invention provides, in one embodiment, a "Bahama" style awning that attaches to a structure in a conventional manner that permits light and air to enter the structure, that can be utilized to protect against major storms, and that can pass strict building code standards testing, as described herein. In an alternate embodiment, the invention provides a "Colonial" style shutter that is inexpensive, easy and quick to manufacture, that can provide protection against major storms, and that can pass strict building code standards testing, as described herein.

The awning embodiment can include a perimeter framework to retain a plurality of horizontal louver slats that include openings between adjacent louvers to allow air and light to enter the structure to which the awning is attached, and to permit persons within the structure to see out. The perimeter framework is adapted to receive a substantially planar, removable rigid plate that, when in place, can extend from the perimeter framework to cover the entire louvered area. The rigid plate can provide security and protection against major storms, and need only be inserted into the awning when additional security and protection is required.

The awning can be made nearly any size or shape, with substantially rectangular being the preferred shape. The perimeter framework can include a pair of substantially vertical members, or jams, forming a left and a right edge of the awning. A pair of substantially horizontal members form an upper edge and a lower edge of the framework. The rigid plate can be removably disposed in a pair of fitted vertical slots, one slot in either vertical jam. The lower horizontal member includes matching slots, that align with the slots in the jams, for receiving the rigid plate. Once fully inserted into the slots, the plate can be attached to the perimeter framework by conventional removable fasteners, such as stainless steel screws.

The awning can attach at the upper edge by a hinge mechanism to the upper edge of the window, doorway, or other opening. The awning can rotate about the hinge from an open position to a closed position covering the opening in the structure to which the awning is attached. One or more support arms can be used to retain the lower edge of the awning at a preselected distance from the lower edge of the opening.

The awning with the rigid plate in place provides protection against major storms and can pass strict building code standards testing such as Dade County Florida's large missile impact test consisting of a length of 2"×4" wood weighing 9 pounds shot from an air cannon at approximately 34 miles per hour directly into the shutter. The awning can further withstand cyclic air testing consisting of cyclic air pressures with a peak equivalent to 48 pounds per square foot in the inward direction and 80 pound per square foot in the outward direction. In addition, the awning can withstand other building code standards, such as the Southern Building Code Congress International (SBCCI).

In an alternate embodiment, a shutter includes a perimeter framework that retains a plurality of horizontal louvers that provide a solid protective covering. Like the awning embodiment discussed above, the shutter embodiment can be made nearly any size or shape, with substantially rectangular being the preferred shape. The framework can include a pair of substantially vertical members, or jams, forming a left and a right edge, and a pair of substantially horizontal members forming an upper edge and a lower edge of the framework. The shutters can attach along one vertical edge by a hinge mechanism to an edge of the window, doorway, or other opening of the structure to which the shutter is attached. The shutter can be rotated about the hinge to cover the window or doorway, and can be sized to cover the entire opening into the structure.

Two shutters can be utilized, one attached to each vertical edge of the window or door and sized to cover the opening when each are closed. The shutter edges opposite the hinge mechanisms can meet together in between the vertical edges of the window or door preferably near the vertical center, and can be connected together to provide additional security.

A plurality of shutter panels can be connected together at adjacent edges to form extra wide shutter assemblies, for extra wide openings. The connection of the shutter panels at adjacent edges can be rigid or foldable.

The shutter embodiment remains in the open position as a decorative accessory to a window or doorway, and, when desired, covers the window or doorway in the closed position to provide security or storm protection. Therefore, the louvers utilized in the shutter embodiment do not require openings between adjacent louvers to allow air and light to pass, such as in the louvers in the awning embodiment. The louver sections for the shutters can thus be solid sections suitable for protection against major storms, and that can pass strict building code standards, such as discussed herein above.

The louvers for each shutter panel can be made of at least one unitary section of preselected size, that can be made of extruded aluminum. A plurality of louvered sections of preselected width can be made that interlock together in length to form modular louvered sections of nearly any size.

Accordingly, it is an object of the present invention to provide an awning that lets in light and air, that can protect against storms, and that can pass strict building code standards testing.

It is another objective of the present invention to provide a shutter that can include modular enclosed louvered sections, can be closable to provide protection against storms, and that can pass strict building code standards testing.

In accordance with these and other objects which will become apparent hereinafter, the instant invention will now be described with particular reference to the accompanying drawings.

DETAILED DESCRIPTION OF THE INVENTION

Figure 1:
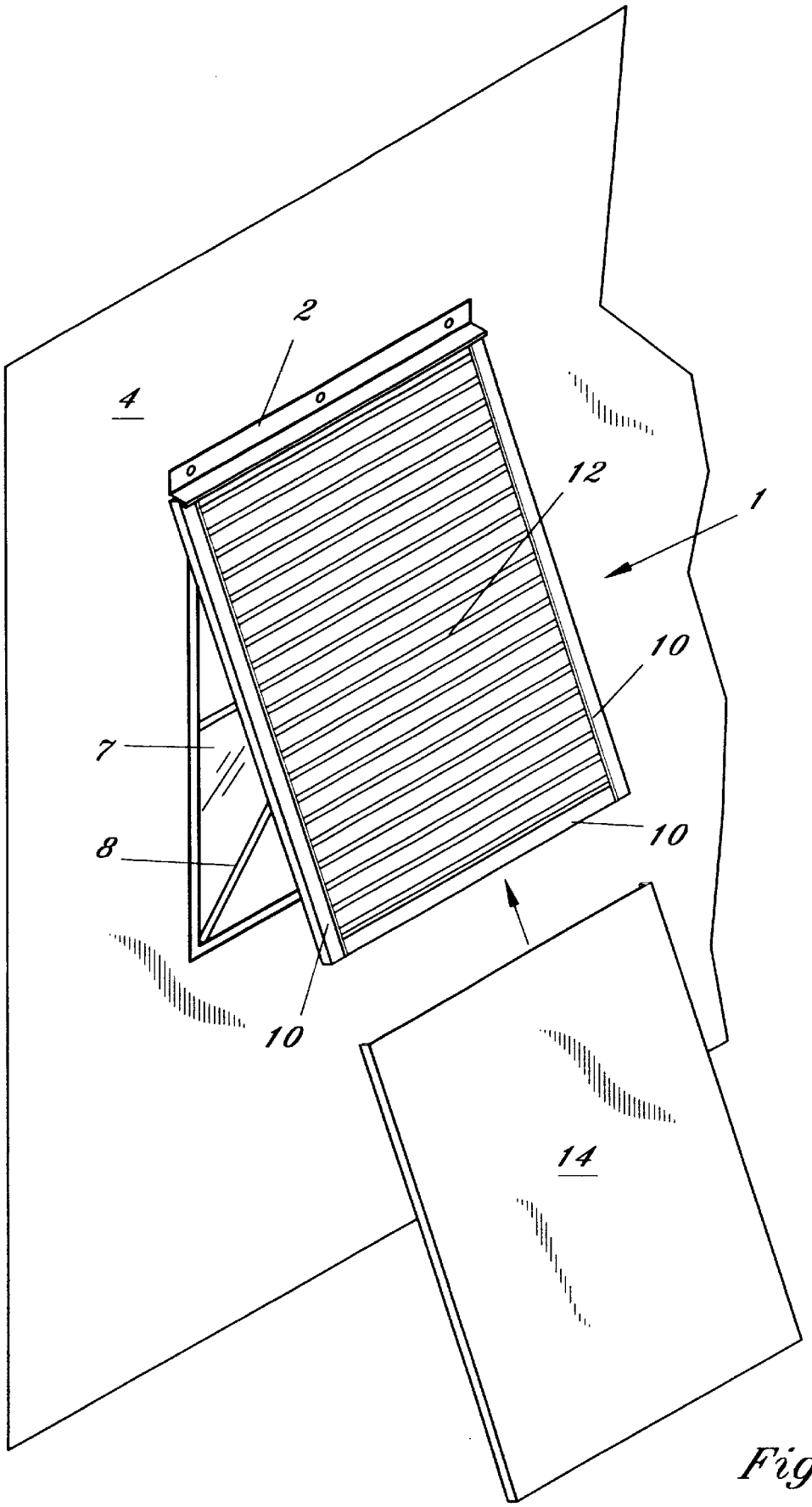
FIG. 1 is a front perspective view of a first embodiment of the present invention in use.

Referring to FIG. 1, a first embodiment of the present invention, a "Bahama" style awning shown generally as 1, is illustrated attached by hinge mechanism 2 to a structure 4 over window 6. Awning 1 can rotate about hinge mechanism 2, from an open position as shown to a closed position against structure 4 and covering window 6. Support arms 8 can be used to retain awning 1 in the open position a at a preselected angle relative to window 6. Structure 4 can be a dwelling, store, warehouse, or other structure. Window 6 can include nearly any opening in structure 4 of nearly any shape. Awning 1 can be shaped to correspond to the shape of window 6, with rectangular being the preferred shape, and as illustrated in FIG. 1.

Awning 1 includes perimeter framework 10, to retain a plurality of louver slats 12. Substantially planar, rigid support plate 14 is removable from awning 1, as fully described herein below.

Figure 2:
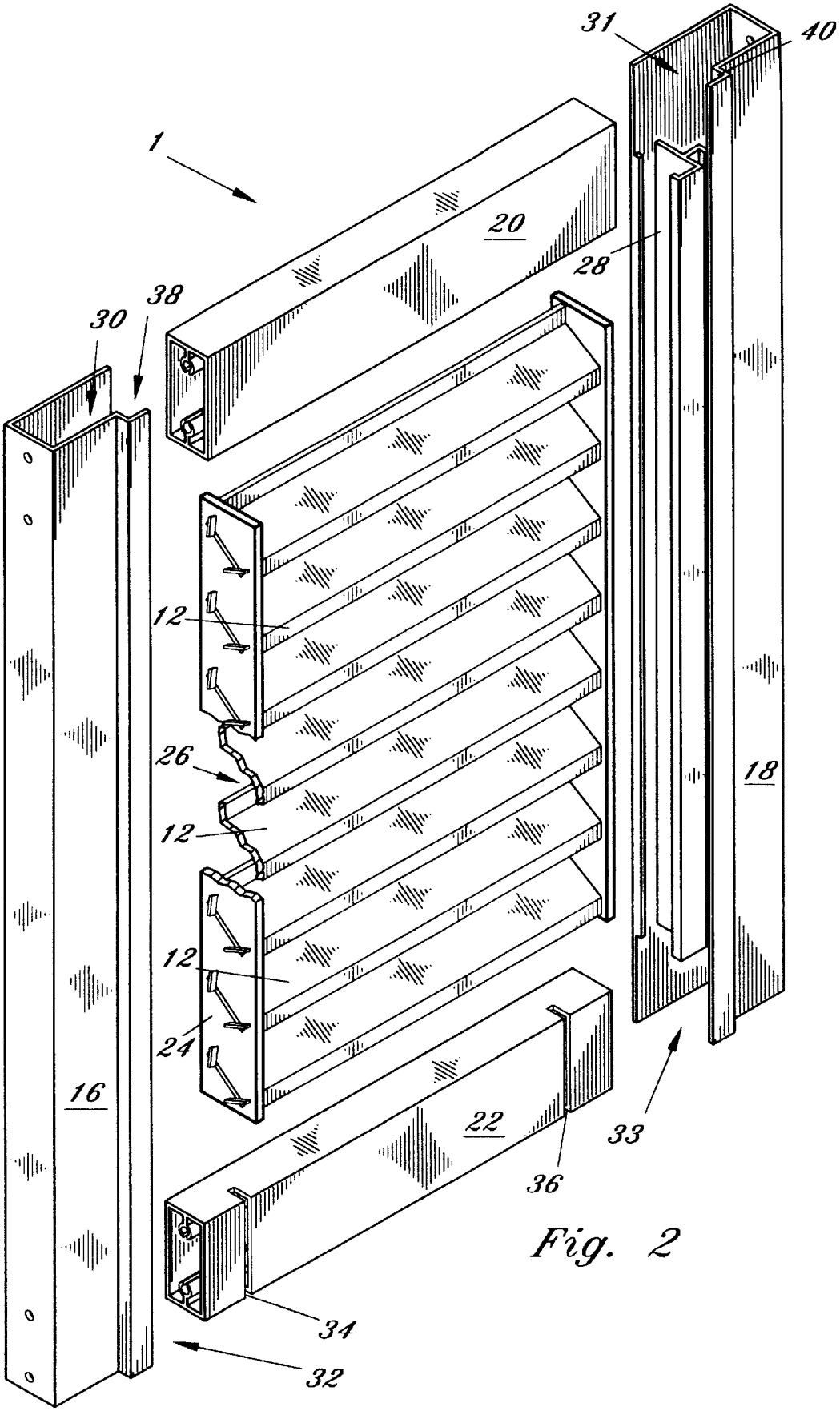
FIG. 2 is a exploded front perspective view of the awning of FIG. 1.

Referring to FIG. 2, awning 1 is illustrated in a front exploded view. Perimeter framework 10 includes substantially vertical members, or jams 16 and 18 which form the vertical edges of framework 10. Substantially horizontal members 20 and 22 form the upper member and lower member, respectively of framework 10. A plurality of louvers 12 are held together at each end by identical support members 24. Louvers 12 are retained in support members 24 in conventional manner, as known in the art. Louver support members 24 retain louvers 12 such that apertures 26 are maintained between adjacent louvers 12. Apertures 26 allow light and air to pass through awning 1, and allow persons within structure 4 to see out of window 6 with awning 1 in place, as shown in FIG. 1.

Louver support members 24 are inserted into identical slots 28 in jams 16 and 18. Upper member 20 is inserted into recessed areas 30 and 31 in jams 16 and 18 respectively, and lower member 22 is inserted into recessed areas 32 and 33 in jams 16 and 18, respectively. Jams 16 and 18, upper member 20, lower member 22 and louvers 12 are assembled as described above, and secured together by stainless steel rivets or stainless steel screws, or other conventional fasteners, to form awning 1.

Figure 4:
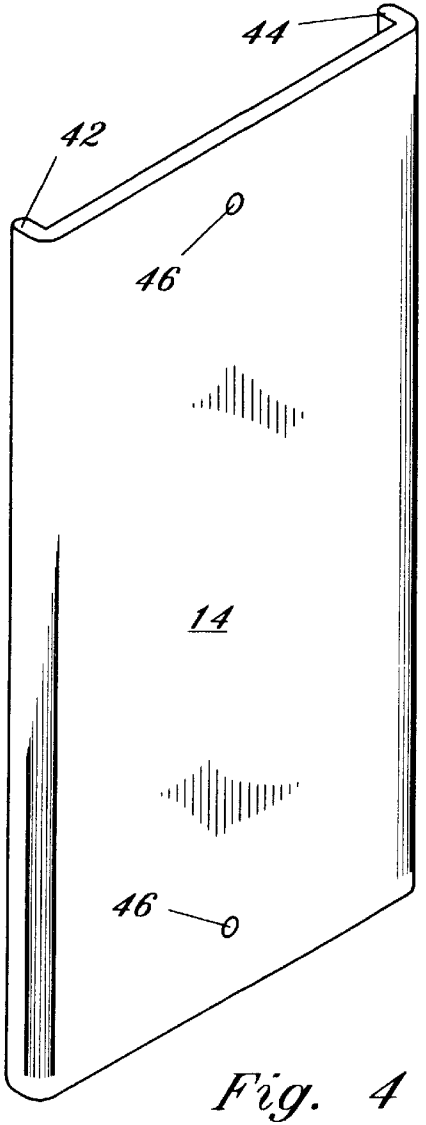
FIG. 4 is a perspective view of the rigid support plate of the first embodiment of the present invention.
Figure 3A:
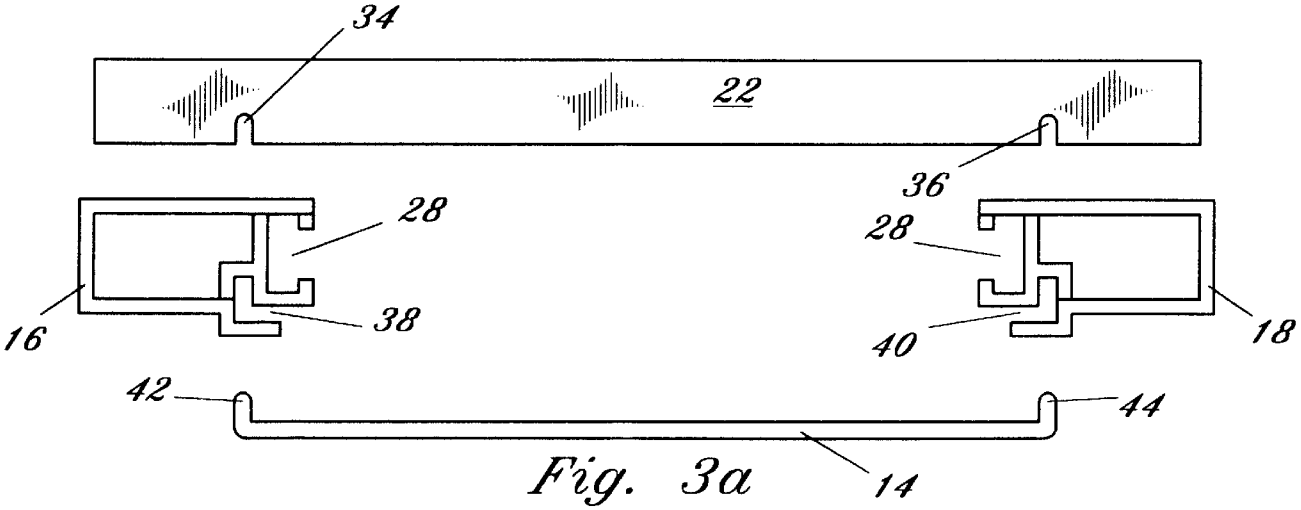
FIG. 3*a* is an exploded, inverted, bottom plan view of the awning of FIG. 2.
Figure 3B:
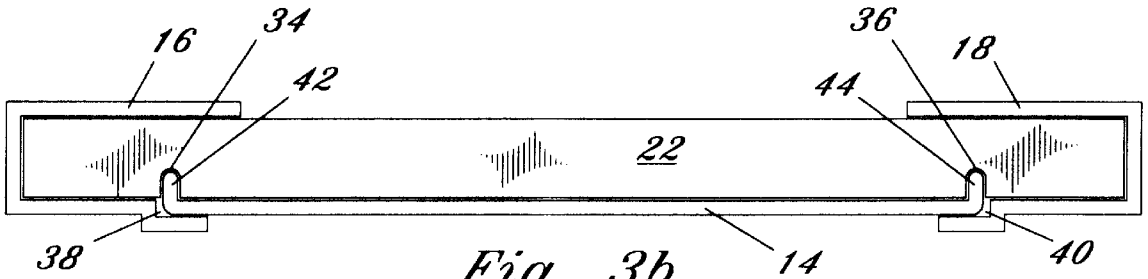
FIG. 3*b* is an inverted bottom plan view of the awning of FIG. 2.

Referring to FIGS. 3*a* and 3*b,* lower member 22 includes slots 34 and 36, which align with recessed areas 38 and 40 in jams 16 and 18, respectively. Rigid plate 14 includes protruding portions 42 and 44, as shown in FIG. 4. Rigid plate 14 within protruding portions 42 and 44 can thus be slid into slots 34 and 36 and into recessed areas 38 and 40, as shown in FIGS. 1 and 3*a*–3*b*. Rigid plate 14 can include one or more apertures 46 for attachment by conventional removable fasteners to perimeter framework 10.

Thus for storm protection, rigid plate 14 can be inserted and secured to awning 1 while awning 1 is attached to structure 4. Support arms 8 can be lowered to close awning 1 against window 6. Once in place, awning 1 can provide storm protection even against major storms such as hurricanes, and can pass strict building code standards testing, as described herein above.

It is preferable in the first embodiment, as illustrated in FIGS. 1 and 2, that rigid plate 14 be disposed in front of louvers 12 to protect louvers 12 from storm damage. In the embodiment where rigid plate 14 is disposed in front of louvers 12, FIGS. 3*a* and 3*b* are illustrated in an inverted or upside-down orientation. Alternately in the first embodiment, rigid plate 14 can be placed behind louvers 12. As can be seen from FIGS. 1, 2, 3*a,* and 3*b*, shutter 1 can be assembled and attached to structure 4 such that rigid plate 14 can be disposed in front of or behind louvers 12. In the embodiment where rigid plate 14 is disposed behind louvers 12, FIGS. 3*a* and 3*b* are not inverted.

Figure 5:
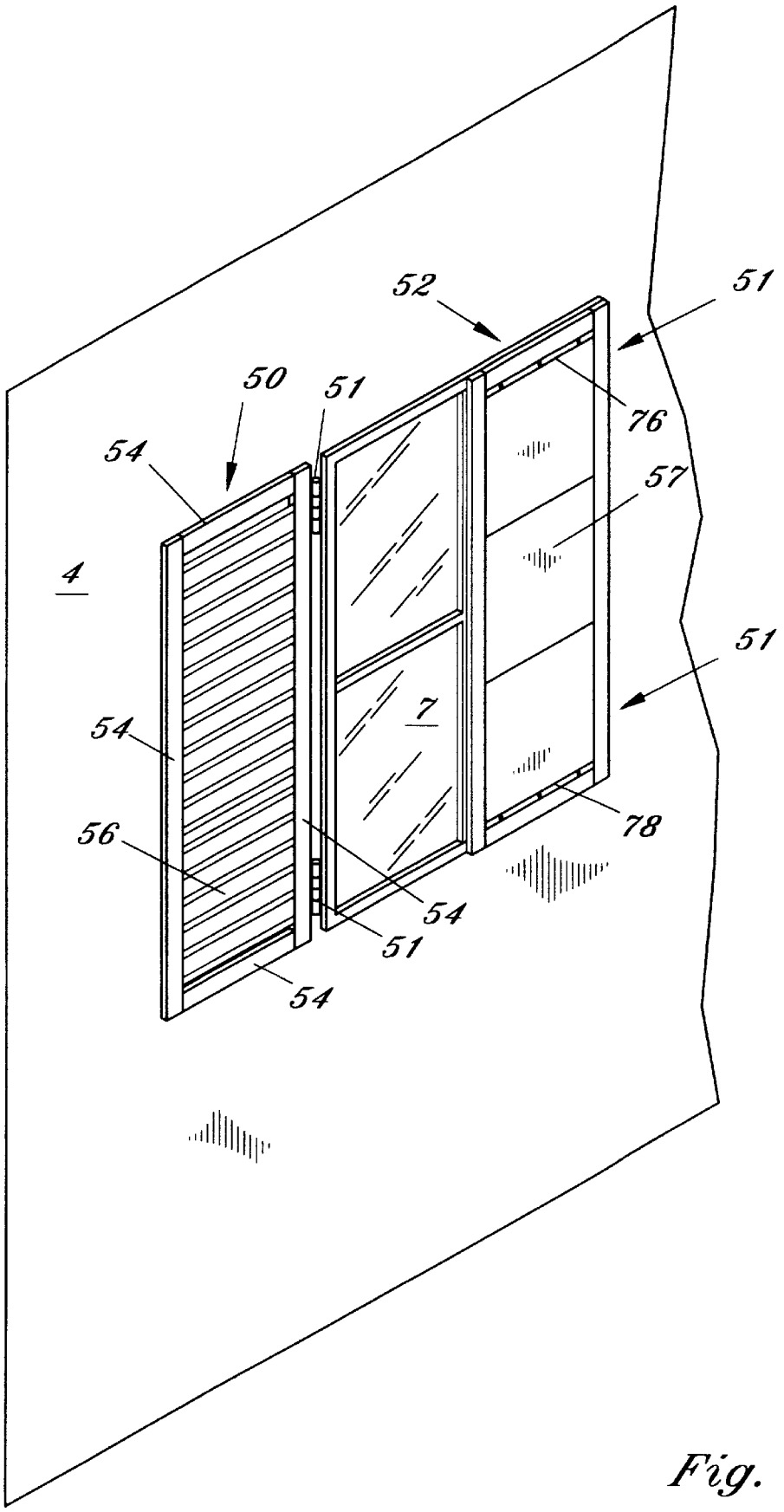
FIG. 5 is a front perspective view of a second embodiment of the present invention in use.

Referring to FIG. 5, a second embodiment of the present invention, a pair of "Colonial" style shutters shown generally as 50 and 52, are illustrated attached by conventional hinge mechanisms 51 adjacent window 7 of structure 4. Shutter 50 is shown in the open position, and shutter 52 is shown in the closed position covering a portion of window 7. When shutters 50 and 52 are both closed, window 7 is fully covered.

Window 7 can be any size or shape opening into structure 4. Shutters 50 and 52 could be made nearly any size or shape to correspond to window 7. Alternately, a single large shutter could be made to cover window 7, or a plurality of shutters could be made, and rigidly or foldably connected at adjacent edges, as known in the art, to cover window 7.

In the preferred embodiment, shutters 50 and 52 are rectangular, and are sized in width approximately one half the width of window 7, and when closed meet near the vertical center of window 7. Shutters 50 and 52 are identical and only one of which will be described herein to avoid repetition.

Shutter 50 includes a perimeter framework 54 and a plurality of louvers 56. Louvers 56, as fully described herein below, include a substantially planar rigid solid back portion 57. "Solid" referring to the substantial lack of openings or apertures between adjacent louver slats 56.

Figure 6:
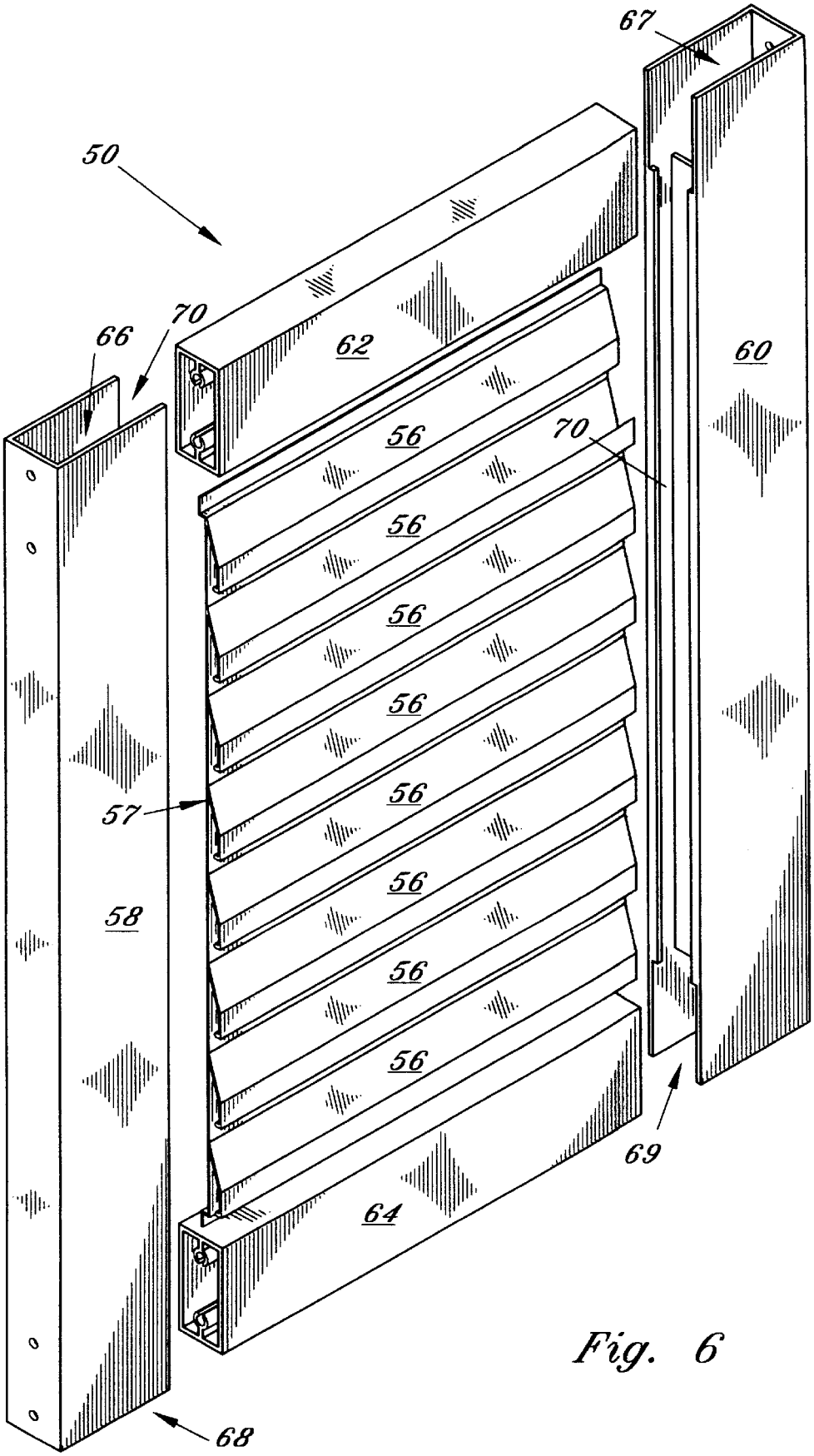
FIG. 6 is an exploded front perspective view of the shutter of FIG. 5.

Referring to FIG. 6, shutter 50 includes substantially vertical members or jams 58 and 60, and substantially horizontal upper member 62 and substantially horizontal lower member 64. Upper member 62 inserts into recessed areas 66 and 67 in jams 58 and 60, respectively. Lower member 64 inserts into recessed areas 68 and 69 in jams 58 and 60, respectively. Louvers 56, with rigid back portion 57, insert into identical slots 70 in jams 58 and 60. Once assembled, jams 58 and 60, upper member 62 and lower member 64, and louvers 56 are connected together using stainless steel rivets, stainless steel screws, or other conventional fasteners, to form shutter 50.

Figure 7A:
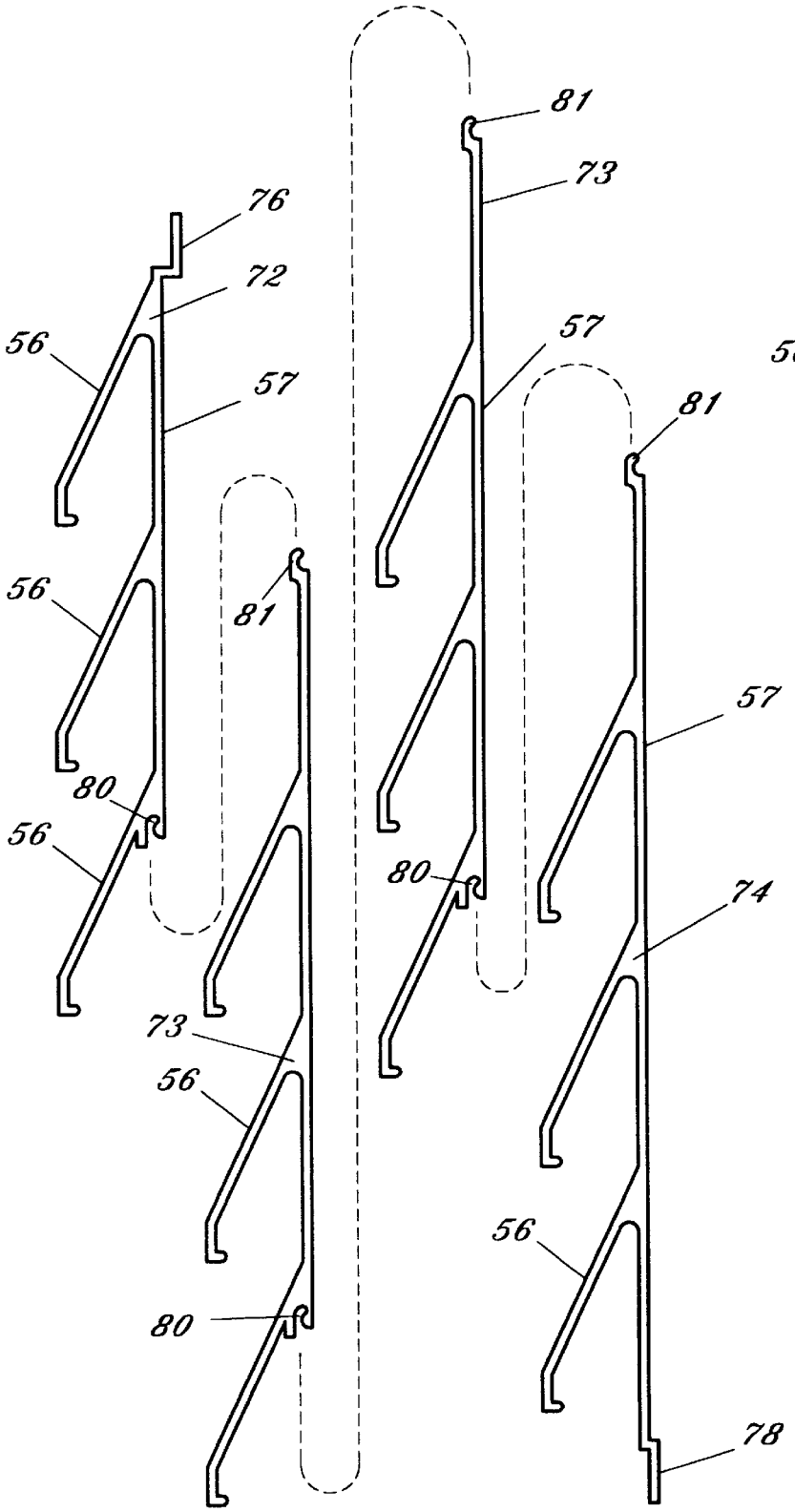
FIG. 7*a* is an exploded side elevational view of an alternate embodiment of louvers.
Figure 7B:
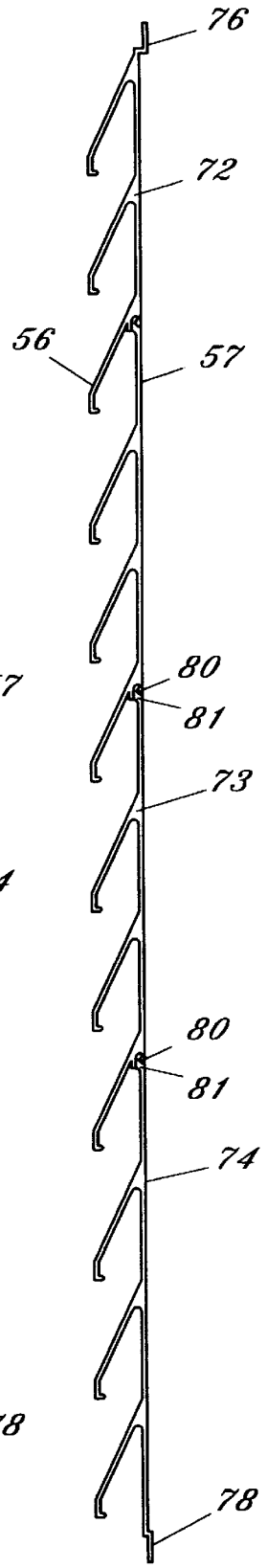
FIG. 7*b* is a side elevational view of the louvers FIG. 7*a*.

Referring to FIGS. 7*a* and 7*b,* louvers 56 include a substantially planar rigid back portion 57. Louvers 56 can be made in modular louver sections comprised of upper section 72, lower section 74, and any number of inner louver sections 73. Each louver section 72–74 can include at least one louver 56, and are illustrated in FIGS. 7*a* and 7*b* with three louvers 56 each. Louvers sections 72–74 can be combined together, as described below, to fit any length shutter 50.

Upper louver section 72 can include upper stepped portion 76 on back portion 57, which connects to upper member 62 during assembly by suitable fasteners, such as stainless steel rivets, screws, and the like. Lower louver section 74 can include lower stepped portion 78 on back portion 57, which connects to lower member 64 during assembly also by suitable fasteners, such as stainless steel rivets, screws, and the like.

Opposite upper stepped portion 76, upper louver section 72 includes a first connector 80. Opposite lower stepped portion 78, lower louver section 74 includes a second connector 81. Connectors 80 and 81 are meting connectors, sized and shaped to removably interconnect together to form a rigid connection between adjacent louvers. Inner louver sections 73 include a first connector 80 on an upper edge and a second connector 81 on a lower edge. Thus, upper louver section 72 can be connected directly to lower louver section 74, or one or more inner louver sections 73 can be connected between upper louver section 72 and lower louver section 74, as illustrated in FIGS. 7*a* and 7*b*.

First connector 80 is illustrated as a "female" connector, and second connector 81 is illustrated as a "male" connector. Alternately, first connector 80 can be a male connector and second connector 81 can be a female connector. It is only critical that connectors 80 and 81 mate together to rigidly connect adjacent modular louvered sections, not which is the "male" or which is the "female" connector.

Figures 8A, 8B:
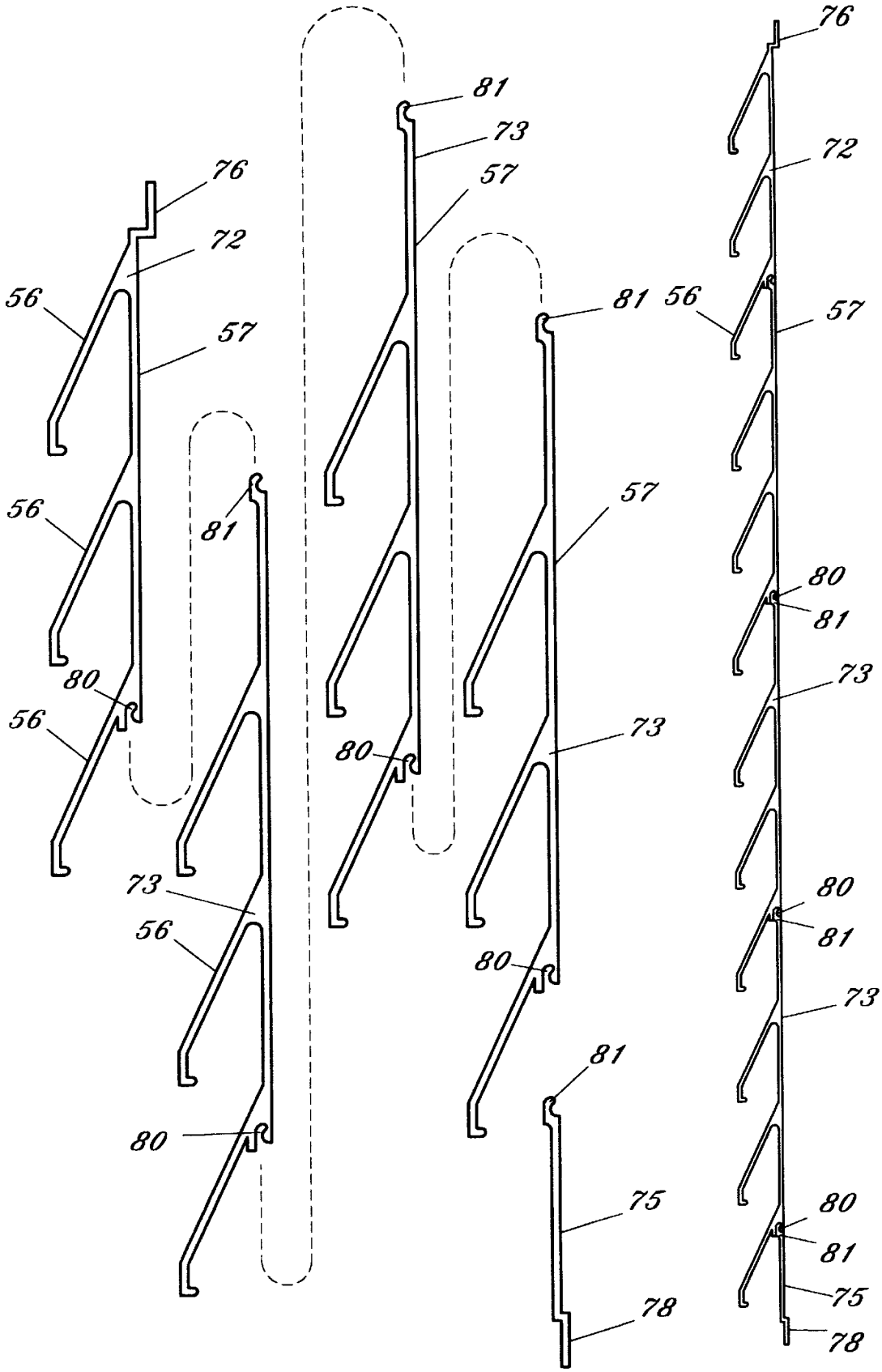
FIG. 8*a* is an exploded side elevational view of an alternate embodiment of the louvers shown in FIG. 7*a*.
FIG. 8*b* is a side elevational view of an alternate embodiment of the louvers shown in FIG. 7*b*.

FIGS. 8*a* and 8*b* illustrate an alternate embodiment that utilizes lower section 75 in-place of lower section 74. Section 75 continues back portion 57, but does not have any louvers 56.

Thus, the louvered sections 72–74 and 75, forming rigid back portion 57, can have nearly any number of louvers 56, or none. The louver sections 72–74 and 75 can be made of extruded aluminum of nearly any size, and can be modularly assembled to form nearly any size and length shutter 50. Alternately, one louvered section can be made, which can have back portion 57 with upper stepped feature 76 and lower stepped feature 78, to be used as a single louver section that when attached to perimeter framework 54 forms shutter 50.

When shutter 50 and shutter 52, with louvers 56 having solid rigid back 57, are closed and secured over window 7, security and protection against major storms is provided to structure 4. In addition, the shutters can pass strict building code standards testing as described herein above.

Figure 9:
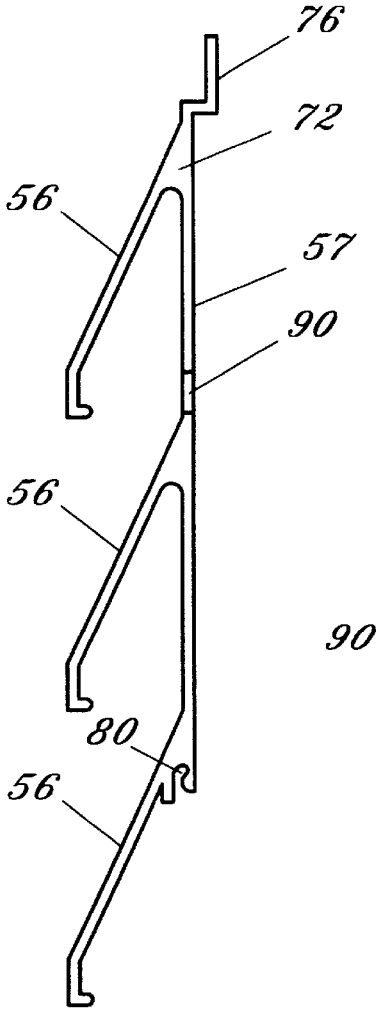
FIG. 9 is a side elevational view of an alternate embodiment of an upper portion of the louvers shown in FIGS. 7*a*, 7*b*, 8*a*, and 8*b*.
Figure 10:
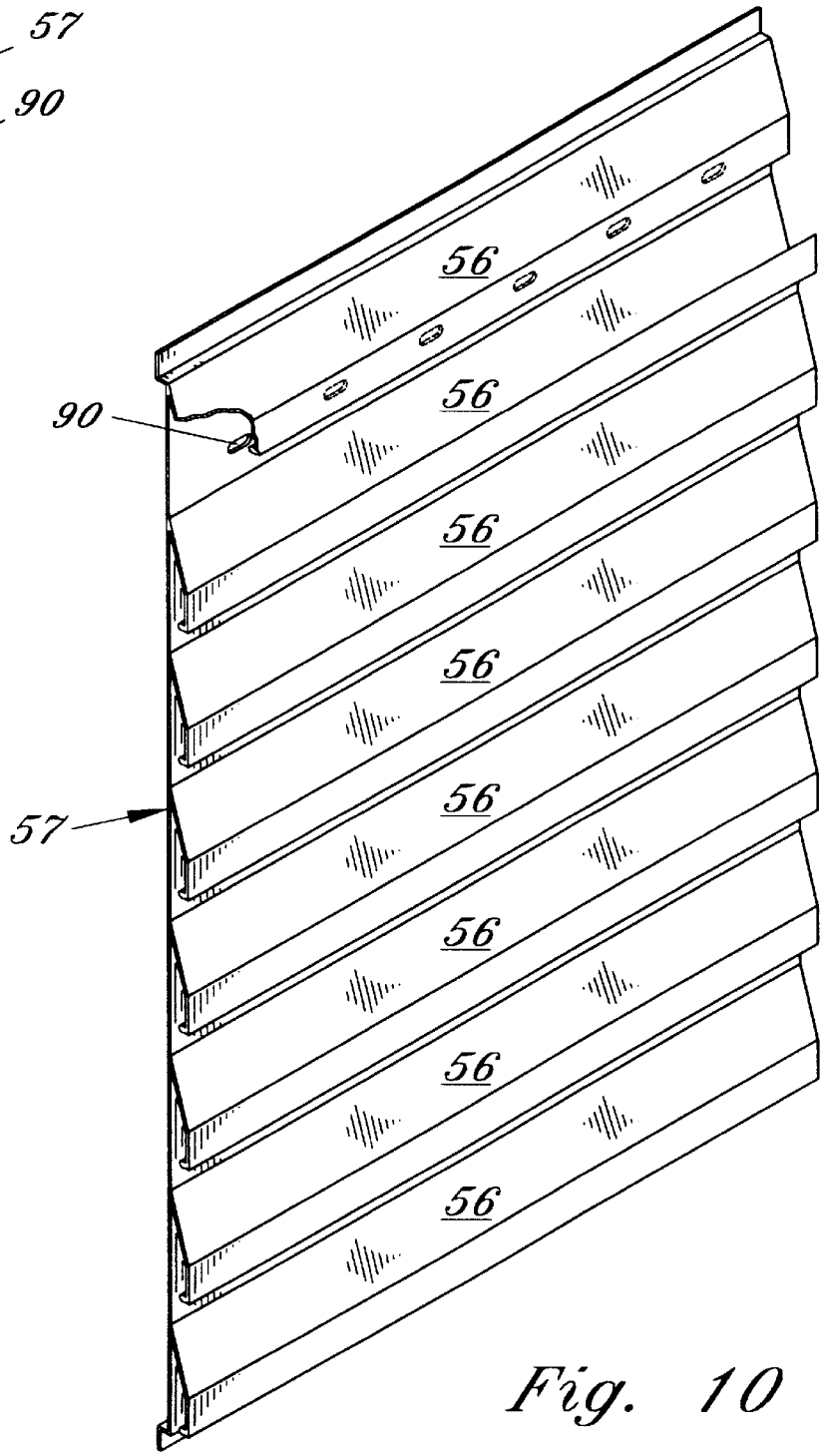
FIG. 10 is a front perspective view of that shown in FIG. 9.

Referring to FIGS. 9 and 10, the louvered sections illustrated in FIGS. 7*a*, 7*b*, 8*a*, and 8*b* can include one or more apertures 90 for viewing out and allowing light in while the shutters are in place over a window. Six apertures 90 are shown in upper louver section 72, however, more or fewer apertures 90 can be utilized. In addition, while apertures in the upper louvered section are preferable, apertures can also be disposed in other louvered sections. The louvered sections illustrated in FIGS. 7*a*–10 can be utilized with any shutter type, including the "Bahama" or "Colonial" type shutter.

The "Bahama" and "Colonial" shutter types described herein above are not intended to be limiting to only two attachment styles or mechanisms. The features described herein above for the "Bahama" style shutters can be utilized in a "Colonial" style shutter, and the features described herein above for the "Colonial" style shutters can be utilized in a "Bahama" style shutter. The features of the invention described as "Bahama" and "Colonial" type shutters can be utilized in alternate shutter types not specifically listed herein, and are considered within the scope of the present invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An awning for storm protection of an external opening in a structure, comprising:

a perimeter framework having a pair of substantially vertical members spaced apart from each other, a pair of substantially horizontal members spaced apart from each other, said substantially vertical and said substantially horizontal members connected together and defining an interior area said framework adapted to be attached externally to said structure adjacent said structure's external opening;

a plurality of louver slats connected to said framework and substantially filling said interior area;

a substantially planar one-piece rigid member removably connectable to said perimeter framework and sized to cover said interior area, said perimeter framework including means for removably receiving said rigid member.

2. The awning of claim 1 wherein said means for removably receiving said rigid member includes a pair of flange members defining a pair of substantially vertical recessed areas, each recessed area adapted to receive one side edge of said rigid member.

3. The awning of claim 1 wherein said pair of substantially horizontal members includes an upper member and a lower member, said perimeter framework is connectable to the structure by at least one hinge, said at least one hinge connected to said upper member and to the structure at a location which is adjacent and above the external opening of said structure said awning being movable about said at least one hinge between a first position covering the external opening wherein said lower member is substantially flush against the structure and a second position wherein said lower member is spaced apart from the structure.

4. The awning of claim 1 wherein said rigid member is adapted to be removably connectable to said framework while said framework is attached to the structure.

5. The awning of claim 1 further including means for retaining said rigid member in proper position covering said interior area.

6. An awning for storm protection of an opening in a structure, comprising:

a perimeter framework having a pair of substantially vertical members spaced apart from each other a pair of substantially horizontal members spaced apart from each other, said substantially vertical and said substantially horizontal members connected together and defining an interior area;

a plurality of louver slats connected to said framework and substantially filling said interior area, each adjacent pair of said louver slats and said pair of substantially vertical members defining an aperture therebetween;

a substantially planar rigid member removably connectable to said perimeter framework and sized to cover said interior area, said perimeter framework including means for removably receiving said rigid member;

wherein said rigid member includes a pair of outer protruding edges and said means for removably receiving includes a pair of grooves in at least one of said horizontal members, each groove adapted to receive a respective protruding edge of said rigid member.

7. The awning of claim 6 further including means for retaining said rigid member in proper position covering said interior area.

8. The awning of claim 6 wherein said pair of substantially horizontal members includes an upper member and a lower member, said perimeter framework is connectable to the structure by at least one hinge, said at least one hinge connected to said upper member and to the structure at a location which is adjacent and above the opening of said structure, said awning being movable about said at least one hinge between a first position covering the opening wherein said lower member is substantially flush against the structure and a second position wherein said lower member is spaced apart from the structure.

9. The awning of claim 6 wherein said rigid member is adapted to be removably connectable to said framework while said framework is attached to the structure.

10. The awning of claim 6 wherein said rigid member is one-piece.

11. An awning for storm protection of an opening in a structure, comprising:

a perimeter framework having a pair of substantially vertical members spaced apart from each other, a pair of substantially horizontal members spaced apart from each other, said substantially vertical and said substantially horizontal members connected together and defining an interior area;

a plurality of louver slats connected to said framework and substantially filling said interior area, each adjacent pair of said louver slats and said pair of substantially vertical members defining an aperture therebetween;

a substantially planar rigid member removably connectable to said perimeter framework and sized to cover said interior area, said perimeter framework including means for removably receiving said rigid member;

wherein said means for removably receiving said rigid member includes a pair of flange members defining a pair of substantially vertical recessed areas, each recessed area adapted to receive one side edge of said rigid member;

wherein said rigid member includes a pair of outer protruding edges and said means for removably receiving further includes a pair of grooves in at least one of said horizontal members, each groove disposed to align with one of said recessed areas and adapted to receive a respective protruding edge of said rigid member.

12. The awning of claim 11 further including means for retaining said rigid member in proper position covering said interior area.

13. The awning of claim 11 wherein said pair of substantially horizontal members includes an upper member and a lower member, said perimeter framework is connectable to the structure by at least one hinge, said at least one hinge connected to said upper member and to the structure at a location which is adjacent and above the opening of said structure, said awning being movable about said at least one hinge between a first position covering the opening wherein said lower member is substantially flush against the structure and a second position wherein said lower member is spaced apart from the structure.

14. The awning of claim 11 wherein said rigid member is adapted to be removably connectable to said framework while said framework is attached to the structure.

15. The awning of claim 11 wherein said rigid member is one-piece.

* * * * *